United States Patent [19]

Estes

[11] 4,051,907

[45] Oct. 4, 1977

[54] SELECTIVE FIRING SYSTEM

[75] Inventor: James D. Estes, Houston, Tex.

[73] Assignee: N L Industries, Inc., New York, N.Y.

[21] Appl. No.: 665,807

[22] Filed: Mar. 10, 1976

[51] Int. Cl.[2] ..... E21B 43/116; E21B 43/117

[52] U.S. Cl. ..... 175/4.55; 102/21.6; 361/248

[58] Field of Search ..... 175/4.55, 4.5; 317/80; 166/299, 63, 65 R; 102/21.6, 22, 23

[56] References Cited

U.S. PATENT DOCUMENTS

| | | | |
|---|---|---|---|
| 2,369,238 | 2/1945 | Kaveler et al. | 317/80 X |
| 2,761,385 | 9/1956 | Schlumberger | 317/80 X |
| 2,871,784 | 2/1959 | Blair | 175/4.55 |
| 3,312,869 | 4/1967 | Werner | 317/80 |
| 3,327,791 | 6/1967 | Harrigan, Jr. | 175/4.55 |
| 3,327,792 | 6/1967 | Boop | 317/80 X |
| 3,517,758 | 6/1970 | Schuster | 175/4.55 |
| 3,717,095 | 2/1973 | Vann | 175/4.55 X |
| 3,768,408 | 10/1973 | Hallmark | 175/4.55 X |
| 3,773,120 | 11/1973 | Stroud | 175/4.55 |
| 3,934,514 | 1/1976 | Dawkins | 317/80 X |

*Primary Examiner*—Stephen J. Novosad

[57] ABSTRACT

Selective firing system for gun perforating comprising in combination a surface control, and a subsurface master sub together with a multiplicity of identical slave subs each operatively connected with a perforating charge and so interconnected that any of the slave subs may be armed and fired in any order under the control of the operator.

4 Claims, 4 Drawing Figures

CONTROL UNIT

SLAVE SUB

SELECTIVE FIRING SYSTEM

BACKGROUND OF INVENTION

This invention relates to perforating systems for perforation of oil well casings and more particularly to apparatus for selectively and separately firing individual shaped charges of a perforating system.

In performing completion operations in a well, it is often necessary to selectively activate electrically detonated explosive devices, so that a number of completion operations at separate well depths may be performed with a single trip into a well.

For example, one of the steps in completing oil and gas wells is perforating the casing to allow entry of the oil or gas. In some wells the oil or gas bearing formation is continuous. The casings in these wells are perforated with one or more guns until the entire productive zone is opened.

The productive formation is not always continuous in all wells. There may be wells that have non-productive streaks in the oil-bearing zone and it would not be desirable to perforate these intervals. Multiple short gun runs, blanked-off shots of long guns, and spacers between guns have all been used to selectively perforate the productive zones in these wells. A better solution is a multi-gun tool where the operator can selectively fire each gun separately.

Existing selectively fired perforating systems of which U.S. Pat. Nos. 3,246,707, 3,246,708 and 3,860,865 are representative prior art, consist of several guns connected in series with down-the-hole switches or switch subs. The switches in these subs are such that the bottom gun is set to fire first. The blast from this first gun switches the first switch sub and the second gun is armed. In a like manner the blast from the second gun will arm the third gun, and so on.

Selective fired guns have been used for many years and a number of problems have been encountered. The selected gun may fail to fire because of electrical circuit failures, including shorts or opens in the wire line or in the down-hole circuit. At times the wrong gun or guns may become armed due to an electrical or mechanical failure. If the wrong gun is fired, the well may be perforated in the wrong zone and expensive repairs, such as cementing, may be required. If any gun fails to fire for any reason, the gun above will not be armed and the firing sequence is stopped. As a result the guns must be pulled out of the well for repair or replacement.

The disclosure of U.S. Pat. No. 3,860,865 cited above is hereby included herein by reference.

SUMMARY OF THE INVENTION

The present invention relates to a system for selectively firing in any order and at any time any of the individual perforating guns in a subsurface perforating gun assembly. As is well known, and as illustrated in the patents cited, these commonly consist of an array of guns vertically spaced in an elongated mechanical unit which is lowered into a well and may be positioned therein. The system includes a surface control unit in addition to the subsurface perforating assembly. The operator may select the gun to be fired and his selection is verified by a digital indicator on the controller. If a malfunction occurs in the perforating gun or the wire line, such as a short or open circuit, the inventive system will determine the condition and activate the appropriate "open" or "short" light.

The gun assembly comprises a number of tubular guns separated by subs each containing a digitally controlled firing circuit. There are no moving parts such as relays or switches, and for arming a selected gun it is not necessary to fire the adjacent gun. This is a fully solid state system where each gun is individually selected, armed, and fired by commands from the control unit.

In a perforating operation, the operator will place the lowest "ready to fire" gun in the zone to be perforated. The operator then causes the control unit to interrogate the proper gun and to arm and fire the gun in separate and distinct operations. The sound of the detonation of the jet gun is telemetered from a microphone in the gun assembly to a speaker in the control unit. The operator can tell from the sound when the jet charge fires properly. In the event that the charge fails to fire or fires in low order, the operator can place the next gun above in the same zone and repeat the firing procedure. Normally spare guns are included so that in the event of a misfire, additional runs are avoided.

As mentioned, and as will appear, the inventive system involves solid-state electronics, and the detailed description below will be readily understandable to those skilled in the art. We have used terminology and symbolic notation standard in the art, as described for example in the following texts, which are hereby incorporated herein by reference:

Integrated Circuits in Digital Electronics
A. Barna et al.
New York: Wiley, 1973.
Fundamentals of Digital Logic Circuits
S. Libes
Rochelle Park, New Jersey: Hayden, 1975.
Solid-State Devices Manual
Somerville, New Jersey: RCA Solid-State Division, 1975.

DETAILED DESCRIPTION OF THE INVENTION

Figure 1:
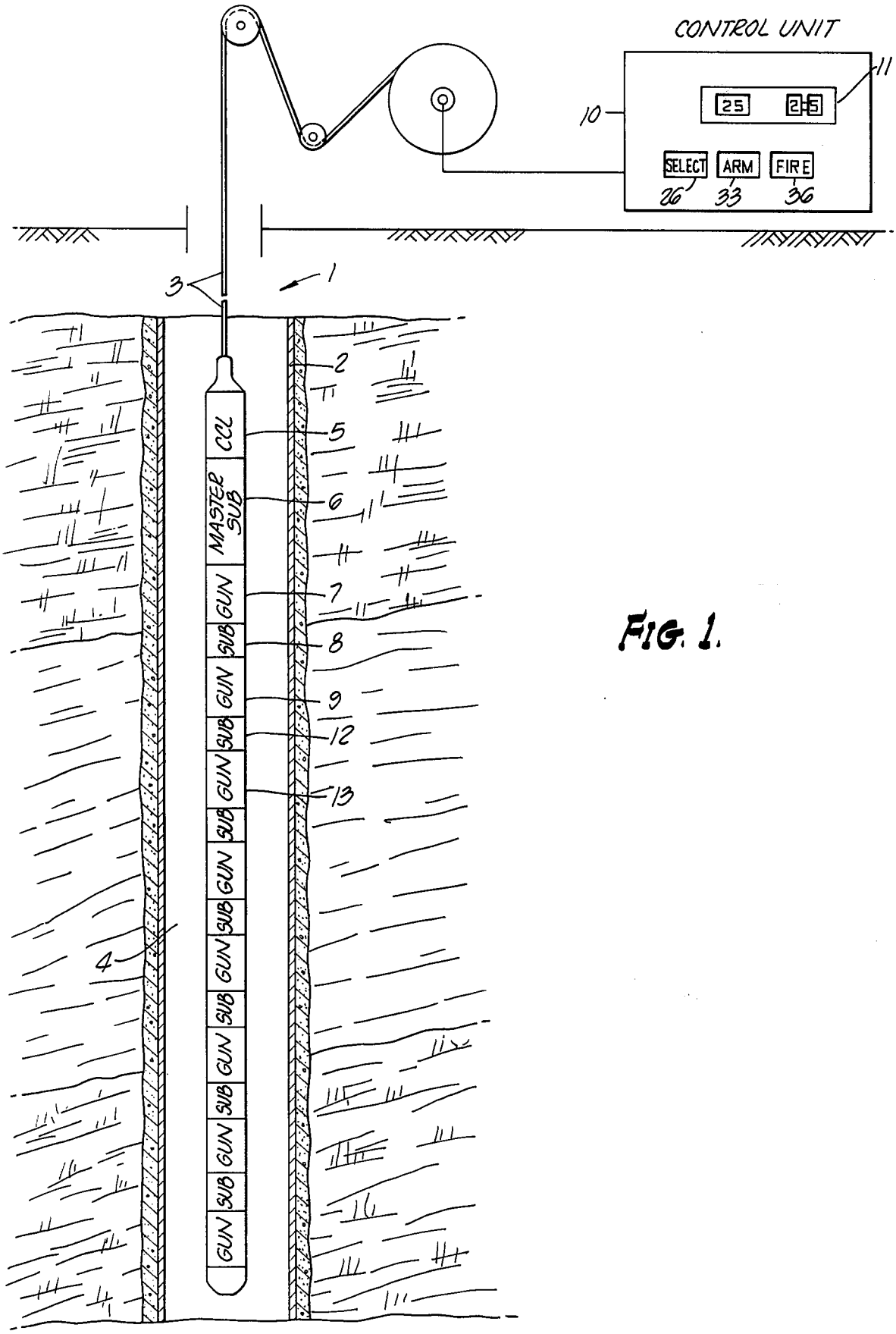
FIG. 1 is an overall view, partly in section, showing the above-ground control unit, the cable, and the down-the-hole gun assembly in place within casing to be perforated.

Turning now to FIG. 1, this shows a well 1 with a casing 2, in which a gun assembly 4 is suspended by a cable 3, which serves to raise, lower, and position the gun assembly as needed, as well as to transmit electrical signals to and from the above-ground control unit 10. A casing collar locator 5 of the usual type enables the operator to keep track of the exact position of the gun assembly.

The gun assembly comprises a master sub 6 with its gun 7, and a multiplicity of slave subs each with its gun, as for example sub 8 with its gun 9, sub 12 with its gun 13, and so on, all to be described in detail hereinbelow.

Also shown in FIG. 1 are the switches 26, 33 and 36 on the panel of the control unit 10, as well as the display 11, all of which will be taken up in detail below.

Figure 2:
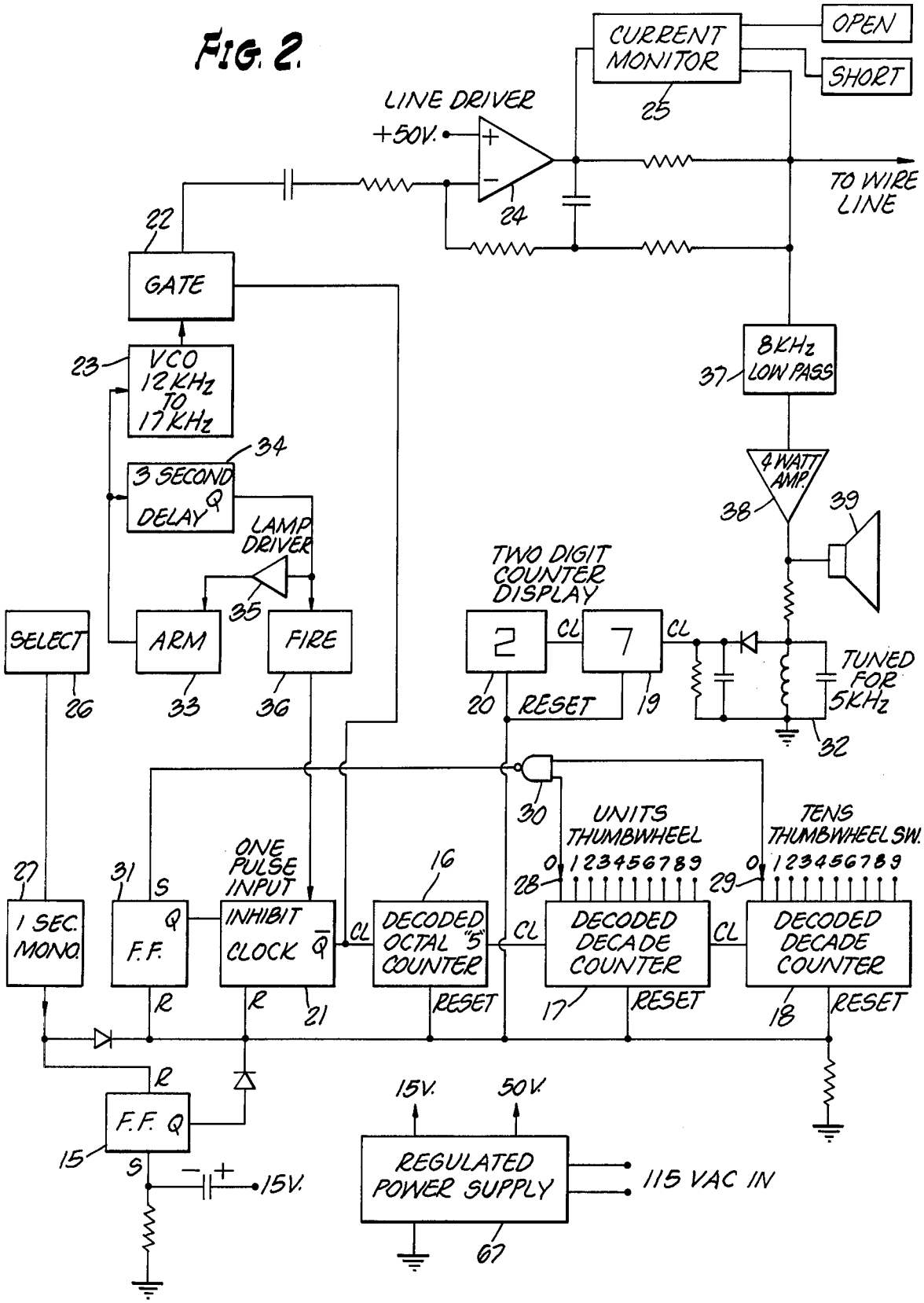
FIG. 2 is a schematic diagram of the control unit.

Turning now to FIG. 2, this shows in schematic form the circuits of the control unit 10. This latter supplies the power to operate the circuits in the master sub 6 and under operator control generates the tone pulses that connect the slave subs 8, 12, etc., and fire the selected guns 9, 13, etc. and eventually 7.

The operation of the circuits shown in FIG. 2 is as follows: Power on sets flip-flop 15 and holds the reset line high resetting counters 16, 17, 18, 19 and 20. The high reset on clock 21 keeps $\bar{Q}$ low and gate 22 open. Power is applied to the wire line but the voltage-controlled oscillator 23 is not.

The operator sets a number on the thumb wheel switches 28 and 29 then presses the select switch 26. The one-second monostable multivibrator 27 resets flip-flop 15 and holds the reset line high for one second. When the reset line goes low, the clock 21 begins producing 50% duty cycle square waves at 300 hertz. Gate 22 is opened and closed at this rate applying the 2 $KH_z$ voltage-controlled oscillator 23 line. Clock pulses are counted by octal counter 16 and each time the count of five is reached, decade counter 17 is advanced. The tens decade counter 18 is advanced by the units decade counter 17. When the output of the counters matches the setting of the thumb wheel switches 28 and 29, NAND gate 30 sets flip-flop 31 and stops clock 21. Clock 21 stops with $\bar{Q}$ high leaving gate 22 closed and the voltage-controlled oscillator 23 applied to the line, through line driver 24, monitored by current monitor 25.

The master sub produces a 5 $KH_z$ burst during the low clock between counts 4 and 5 for each sub that is connected to the string. These bursts are detected by tuned circuit 32 and advance counters 19 and 20.

Pressing the arm switch 33 changes the voltage-controlled oscillator 23 frequency from 12$KH_z$ to 17$KH_z$. After three seconds the delay 34 drives the lamp driver 35 lighting the lamp in the arm switch 33, and supplies power to the fire switch 36. Activating the fire switch at this time causes the clock generator to produce one pulse. This one additional pulse will advance the counter in the selected and armed sub causing the cap and jet charge to fire. The sound of the detonation of this charge is picked up in the microphone in the master sub, transmitted up the wire line through the 8$KH_z$ low pass filter 37, amplified by amplifier 38, and is heard by the operator through speaker 39.

The control unit has operator controls to select, arm and fire any of the guns connected to the wire line and master sub. The number of the sub to be selected is set on the two digit thumb wheel switch 28 and 29. The select switch 26 is depressed, starting a series of tone bursts at 12$KH_z$. Setting the thumb wheel switch at one gives 6 tone pulses and for each additional number gives 8 more tone pulses. The tone stays on after the last pulse.

Figure 3:
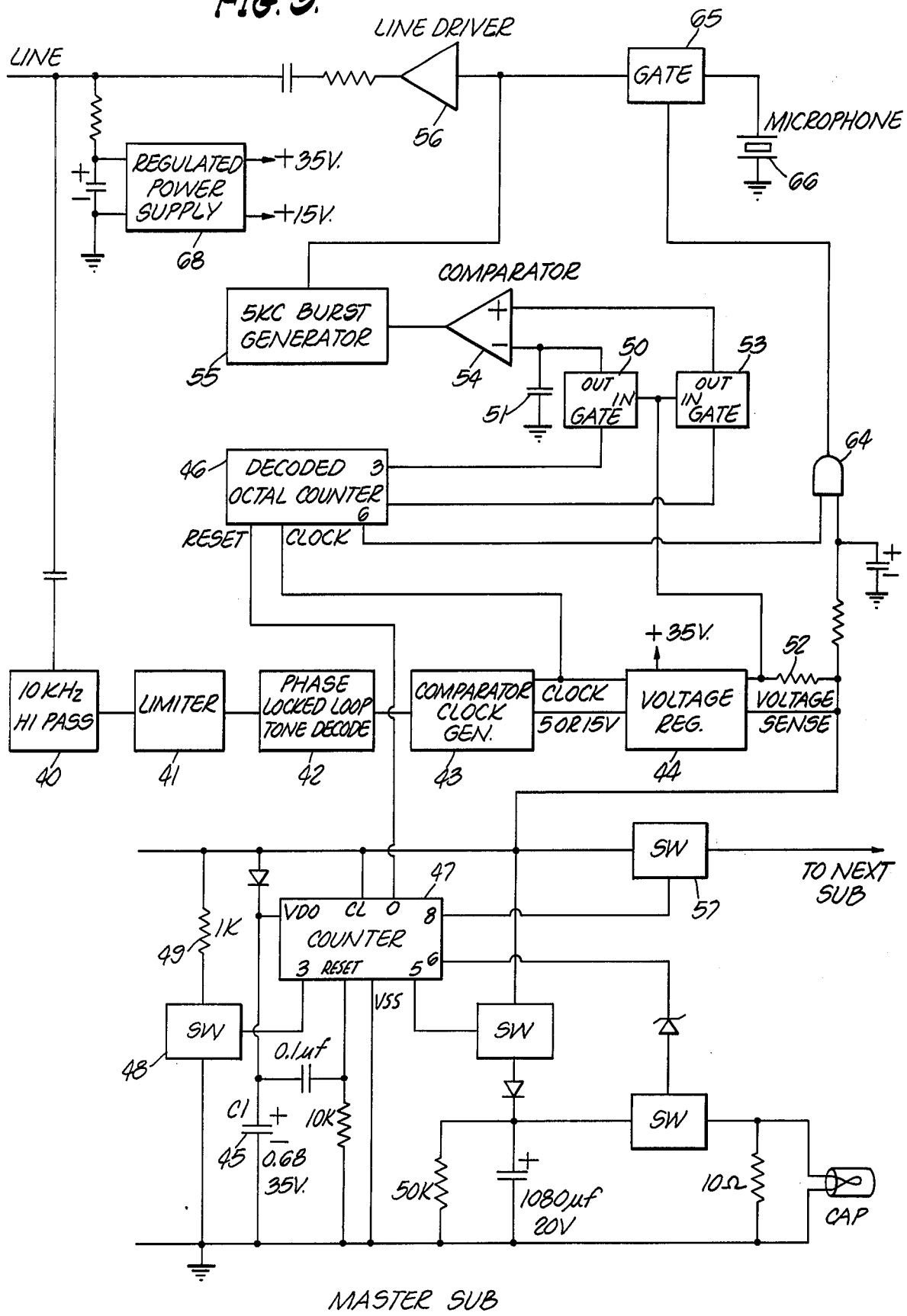
FIG. 3 is a schematic diagram of the master sub.

Turning now to FIG. 3, power for the master sub comes from the control unit, is separated from the control signals, regulated and supplied to all circuits. The tone signals from the control unit are filtered by high-pass filter 40, amplified to full limiting by limiter 41, then changed to a voltage by phase locked loop 42. No tone produces a zero voltage level. 12 $KH_z$ produces 6 volts and 17$KH_z$ – 13 volts.

The comparator-clock generator 43 and voltage regulator 44 work together to produce the voltage pulses used to drive the sub chain. A 12$KH_z$ produces a 5 volt, and 17$KH_z$ a 15 volt level.

The first 5 volt pulse charges capacitor 45 and resets the counters 46 and 47 to zero. The second and third pulses advance the counters 46 and 47. On the fourth pulse, switch 48 is closed adding a one thousand ohm resistor 49 to the circuit causing a larger current to be drawn on this pulse. Gate 50 closes on count 5. This applies a voltage to comparator 54 proportional to the differential current drawn by the sub string between count 4 and 5. A higher current on 4 than 5 causes the output of the comparator 54 to go high. The high output of comparator 54 activates tone generator 55. This generator produces 9 cycles of 5 $KH_z$ that is applied to line driver 56 and is sent to the control unit to advance the sub counter.

The sixth, seventh, and eighth pulses advance counters 46 and 47. The ninth pulse closes switch 57 and inhibits counter 47. The counter 47 in this sub will remain inhibited with switch 57 closed until all voltage is removed from it for one or more seconds. The closing of switch 57 transfers the output of the master sub to the next sub. This operation is continued until the selected sub is reached.

When the selected sub is reached, that sub will receive only six pulses. The sixth pulse will close switch 58. This charges the 1080 u.f. capacitor 59 to 5 volts. If the number set on the thumb wheel switch is the same as the number shown on the L.E.D. sub counter display, then the operator may push the ARM switch 33 on the control box. The 12$KH_z$ tone is raised to 17$KH_z$. The 5 volts supplied to the sub string is raised to 15 volts, charging the capacitor 59 to 15 volts. At this time the red lamp in the ARM switch 33 comes on. Pressing the fire switch 36 adds one more pulse advancing counter 60. The "6" output of counter 60 is more than 10 volts with the ARM switch depressed and 15 volts applied to the sub string. This level of voltage causes 6.8 volt zener diode 61 to conduct, closing switch 62, dumping the charged capacitor 59 into cap 63, firing the gun. At this time AND gate 64 sees a high on both inputs and the output goes high operating gate 65, connecting microphone 66 to the line driver 56. The sound of the detonation of the jet charge is transmitted over the wire line, is amplified by amplifier 38 and is heard by the operator from speaker 39.

Figure 4:
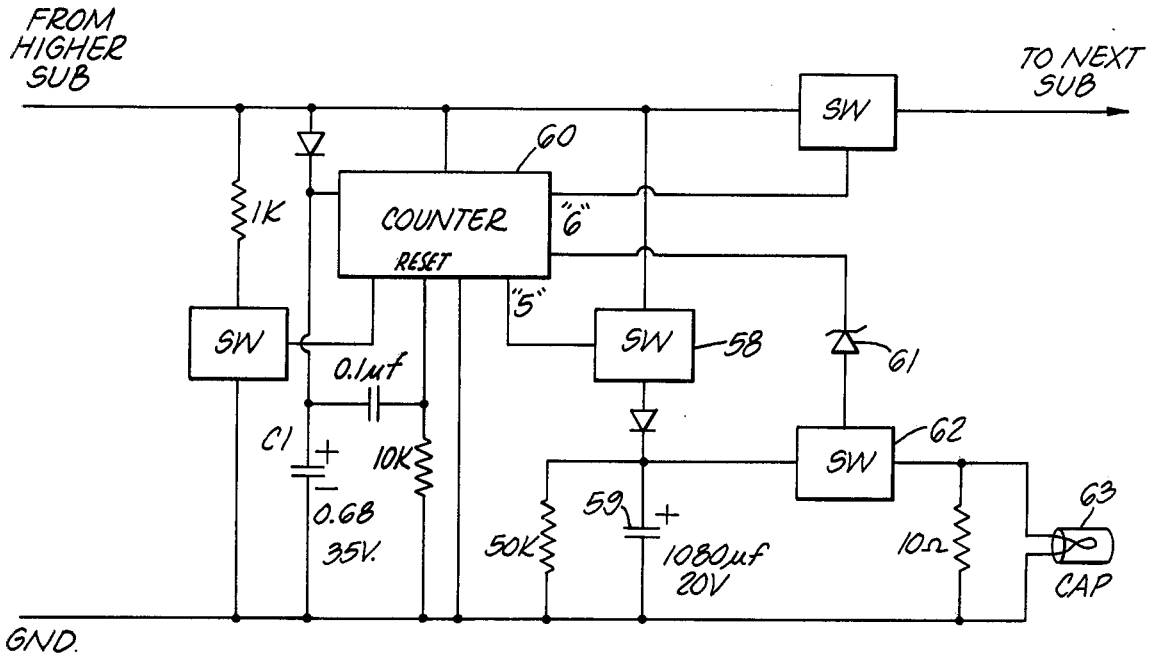
FIG. 4 is a schematic diagram of a slave sub.

All slave subs of course have the same construction and circuit arrangement. Likewise, the master sub incorporates a circuit identical to that of the slave subs, as may be seen by comparing the lower portion of FIG. 3 with FIG. 4.

FIG. 2 shows the regulated power supply 67, deriving power from a 115 volt A.C. source, and providing 15 and 50 volts D.C. where needed in the control unit.

FIG. 3 shows the subsurface power supply 68 which derives power from the line and delivers 15 and 35 volts D.C. as required in the master and slave subs.

From the foregoing description, it will be clear that a basic feature of my invention consists in the fact that a pre-selected number of pulses, which in my best and preferred embodiment is 8 pulses, acts upon the first sub which this octad of pulses reaches and has the effect of converting the sub in effect to a closed switch, so that it acts precisely like a jumper to the next sub. Thus, the first sub reached by such an octad of pulses is master sub 6, and when this happens the circuit is completed to the next sub in line, which is slave sub 8. If the train of pulses consists of 16 pulses, then the first 8 will act on master sub 6, converting it in effect to a jumper, and the following 8 pulses will then act on slave sub 8, converting it in turn to a jumper. If the train of pulses consists of 24 pulses, then the octad comprising pulses 17–24 converts slave sub 12 to a jumper, and so on down the line for any whole multiple of 8 pulses.

On the other hand, should any whole multiple of 8 pulses be followed by 5 pulses, such as a train of 13 or 21 or 29, etc. pulses, then the 5 pulse group will act on the recipient sub not to convert it to a jumper but in contrast to arm it. When this condition is reflected by the surface control unit, the operator may then fire the gun associated with that sub at will. It will be apparent from all of the above that in this fashion any desired slave sub may be armed and fired at will in any selected order.

While I have described the invention with the aid of a detailed illustrative example, I wish it to be understood that I do not desire to be limited to the exact details of construction shown and described, for obvious modifications will occur to a person skilled in the art.

Having described the invention I claim:

1. A perforating gun firing system comprising, in combination, an array of guns vertically spaced in an elongated mechanical unit adapted for lowering into and positioning within a well bore, each of said guns being actuated by a slave sub associated therewith, and said unit having a master sub having its gun operatively connected therewith; an above-ground control means for producing and transmitting to said master sub a series of electrical pulses, the number of which is indicative of the pre-selected slave sub to be armed and fired, said master sub including means responsive to said series of pulses and said slave subs including means selectively responsive to said series of pulses, whereby any of the guns in said array may be armed and fired in a selected order.

2. A system in accordance with claim 1 wherein said series of pulses comprises an even multiple of a first number plus a second number, and wherein each said sub includes means for closing said sub in response to receiving said first number of pulses, but is armed by receiving said second number of pulses.

3. A slave sub means adapted for use in a perforating gun adapted for lowering into and positioning within a well bore, comprising an array of identical such sub means in series connection, said sub means being readily convertible to a jumper or shunt circuit upon receiving a pre-selected number of electrical pulses, and capable of arming and firing its gun upon receiving a different pre-selected number of pulses.

4. A perforating gun firing system comprising, in combination an array of guns vertically spaced in an elongated mechanical unit adapted for lowering into and positioning within a well bore, each of said guns being separately actuated by a sub associated therewith; an above-ground control means for producing and transmitting to said sub a pre-selected number of electrical pulses, said sub includes means for closing said sub in response to receiving a first number of pulses and means capable for arming its gun upon receiving a second number of pulses, said first number being eight pulses, and said second number being five pulses, and means capable of firing said guns in said array in any selected order by said above-ground control means.

* * * * *